US007542898B2

(12) United States Patent
Sato et al.

(10) Patent No.: US 7,542,898 B2
(45) **Date of Patent: *Jun. 2, 2009**

(54) PITCH CYCLE SEARCH RANGE SETTING APPARATUS AND PITCH CYCLE SEARCH APPARATUS

(75) Inventors: Kaoru Sato, Kanagawa (JP); Kazutoshi Yasunaga, Kyoto (JP); Toshiyuki Morii, Kanagawa (JP)

(73) Assignee: Panasonic Corporation, Osaka (JP)

( * ) Notice: Subject to any disclaimer, the term of this patent is extended or adjusted under 35 U.S.C. 154(b) by 28 days.

This patent is subject to a terminal disclaimer.

(21) Appl. No.: 11/619,667

(22) Filed: Jan. 4, 2007

(65) Prior Publication Data

US 2007/0136051 A1 Jun. 14, 2007

Related U.S. Application Data

(63) Continuation of application No. 10/380,626, filed as application No. PCT/JP02/07850 on Aug. 1, 2002, now Pat. No. 7,177,802.

(30) Foreign Application Priority Data

Aug. 2, 2001 (JP) ..... 2001-234559

(51) Int. Cl.
*G10L 19/00* (2006.01)

(52) U.S. Cl. ..... 704/219; 704/207; 704/222; 704/223

(58) Field of Classification Search ..... 704/207, 704/219, 222, 223
See application file for complete search history.

(56) References Cited

U.S. PATENT DOCUMENTS 5,371,853 A 12/1994 Kao et al.
5,819,213 A 10/1998 Oshikiri et al.
5,953,696 A 9/1999 Nishiguchi et al.
6,226,604 B1 * 5/2001 Ehara et al. ..... 704/207

(Continued)

FOREIGN PATENT DOCUMENTS

EP 0745971 12/1996

(Continued)

OTHER PUBLICATIONS

English Language Abstract of JP 6-51800.

(Continued)

*Primary Examiner*—Daniel D Abebe
(74) *Attorney, Agent, or Firm*—Greenblum & Bernstein, P.L.C.

(57) ABSTRACT

An apparatus sets a pitch cycle search object in pitch cycle search processing for searching for a pitch cycle included in a linear predictive residual on a per subframe basis. A pitch cycle indicator of the apparatus sequentially output spitch cycle candidates within a predetermined pitch cycle search range at integral accuracy. A memory stores an integral component of a pitch cycle selected in pitch cycle search processing of a previous subframe. An adaptive sound source vector generator sets, as the pitch cycle search object in pitch cycle search processing in a processing subframe section, a group of candidates comprising a group of integral-accuracy pitch cycle candidates output from the pitch cycle indicator and a group of fractional-accuracy pitch cycle search candidates that cover a pitch cycle near an integral component of the pitch cycle read from the previous subframe integral pitch cycle memory using fractional accuracy.

15 Claims, 8 Drawing Sheets

U.S. PATENT DOCUMENTS

| | | | | |
|---|---|---|---|---|
| 6,345,247 | B1 | 2/2002 | Yasunaga et al. | |
| 6,424,936 | B1 | 7/2002 | Shen et al. | |
| 6,581,031 | B1 * | 6/2003 | Ito et al. | 704/222 |
| 2001/0001139 | A1 * | 5/2001 | Ehara et al. | 704/207 |

FOREIGN PATENT DOCUMENTS

| | | |
|---|---|---|
| EP | 0971337 | 1/2000 |
| JP | 6-51800 | 2/1994 |
| JP | 6-59698 | 3/1994 |
| JP | 6-214600 | 8/1994 |
| JP | 7-225599 | 8/1995 |
| JP | 7-248794 | 9/1995 |
| JP | 6-6398 | 1/1997 |
| JP | 2000-330594 | 11/2000 |

OTHER PUBLICATIONS

English Language Abstract of JP 7-225599.
English Language Abstract of JP 6-59698.
English Language Abstract of JP 6-6398.
English Language Abstract of JP 2000-330594.
English Language Abstract of JP 7-248794.
English Language Abstract of JP 6-214600.
"Code-Excited Linear Prediction (CLEP): High-Quality Speech an Very Low Bit Rates", Schroeder et al., IEEE, 1985, pp. 937-940.
"Design of a Pitch Synchronous Innovation CELP Coder for Mobile Communications", Mano et al., IEEE Journal on Selected Areas in Communications, vol. 13, No. 1, Jan. 1995.
Marques et al., "Improved pitch prediction with fractional delays in CELP coding", ICASSP, Apr. 3, 1990, pp. 665-668.

* cited by examiner

PITCH CYCLE SEARCH RANGE SETTING APPARATUS AND PITCH CYCLE SEARCH APPARATUS

The present application is a continuation application of U.S. patent application Ser. No. 10/380,626 filed on Mar. 21, 2003 now U.S. Pat. No. 7,177,802, which was the National Stage of International Application PCT/JP02/07850 filed on Aug. 1, 2002, which claims the benefit of Japanese Application No. 2001-234559 filed on Aug. 2, 2001, the content of which are expressly incorporated herein by reference in their entireties.

TECHNICAL FIELD

The present invention relates to a pitch cycle search range setting apparatus and pitch cycle search apparatus, and more particularly to a pitch cycle search range setting apparatus and pitch cycle search apparatus used in a CELP (Code Excited Linear Prediction) type speech encoding apparatus.

BACKGROUND ART

In such fields as packet communication typified by digital communication and Internet communication, or speech storage, speech signal encoding/decoding technology is essential for making efficient use of radio wave transmission path capacity and storage media, and many speech encoding/decoding methods have been developed to date.

Among these, a CELP (Code Excited Linear Prediction) type speech encoding/decoding method is widely used as a mainstream method when encoding/decoding speech signals at a medium or low bit rate. A CELP type speech encoding/decoding method is disclosed in Document 1 (Proc. ICASSP '85, pp. 937-pp. 940, 1985).

In a CELP type speech encoding/decoding method, a digitized speech signal is divided into frames of approximately 20 ms, linear predictive analysis of the speech signal is performed every frame and the linear predictive count and linear predictive residual vector are found, and this linear predictive count and linear predictive residual vector are encoded/decoded individually. This linear predictive residual vector is also called an excitation signal vector.

A linear predictive residual vector is encoded/decoded using an adaptive code book that holds drive sound source signals generated in the past and a fixed code book that stores a specific number of fixed-form vectors (fixed code vectors).

This adaptive code book is used to represent a cyclic component possessed by a linear predictive residual vector. On the other hand, the fixed code book is used to represent a non-cyclic component in a linear predictive residual vector that cannot be represented with the adaptive code book. In general, linear predictive residual vector encoding/decoding processing is performed in subframe units resulting from dividing frames into shorter time units (of approximately 5 ms to 10 ms).

With CELP, the pitch cycle is sought from a linear predictive residual vector, and coding is performed. A conventional linear predictive residual pitch cycle search apparatus is described below. FIG. 1 is a block diagram showing the configuration of a conventional pitch cycle search apparatus.

The pitch cycle search apparatus 10 in FIG. 1 is mainly composed of a Pitch Cycle Indicator (PCI) 11, Adaptive Code Book 12 (ACB), Adaptive Sound Source Vector Generator (ASSVG) 13, Integral Pitch Cycle Searcher (IPCS) 14, Fractional Pitch Cycle Adaptive Sound Source Vector Generator (FPCASSVG) 15, Fractional Pitch Cycle Searcher (FPCS) 16, and Distortion Comparator (DC) 17.

The Pitch Cycle Indicator (PCI) 11 sequentially indicates to the Adaptive Sound Source Vector Generator (ASSVG) 13 desired pitch cycles T-int within a preset pitch cycle search range. For example, when the CELP speech encoding/decoding apparatus performs encoding and decoding of a 16 kHz speech signal, and the target vector pitch cycle search range is preset from 32 to 267 at integral accuracy, and from 32+½, 33+½, . . . , to 51+½ at ½ fractional accuracy, the Pitch Cycle Indicator (PCI) 11 outputs 236 kinds of pitch cycle T-int (T-int=32, 33, . . . , 267) to the Adaptive Sound Source Vector Generator (ASSVG) 13. The Adaptive Code Book 12 (ACB) stores drive sound source signals generated in the past.

Next, the Adaptive Sound Source Vector Generator (ASSVG) 13 extracts from the Adaptive Code Book 12 (ACB) the adaptive sound source vector p (t-int) that has integral-accuracy pitch cycle T-int received from the Pitch Cycle Indicator (PCI) 11, and outputs it to the Integral Pitch Cycle Searcher (IPCS) 14.

The processing for extracting adaptive sound source vector p (t-int) that has integral-accuracy pitch cycle T-int from the Adaptive Code Book 12 (ACB) is described below. FIG. 2 is a drawing showing an example of frame configuration.

In FIG. 2, frame 21 and frame 31 are past drive sound source signal sequences stored in the adaptive code book. The Adaptive Sound Source Vector Generator (ASSVG) 13 searches for the frame pitch cycle between lower limit 32 and upper limit 267 of the pitch cycle search range.

As pitch cycle 22 retrieved from frame 21 here is longer than the length of subframe 23, the Adaptive Sound Source Vector Generator (ASSVG) 13 takes section 23 extracted from frame 21 for the frame length of the subframe as the adaptive sound source vector.

Also, as pitch cycle 32 retrieved from frame 31 is shorter than the length of subframe 33, the Adaptive Sound Source Vector Generator (ASSVG) 13 extracts the adaptive sound source vector up to pitch cycle 32, and takes vector section 34, obtained by iterating extracted vector section 33 up to the length of the subframe length, as the adaptive sound source vector.

Moreover, the Adaptive Sound Source Vector Generator (ASSVG) 13 extracts from the Adaptive Code Book 12 (ACB) the adaptive sound source vector necessary when finding the adaptive sound source vector corresponding to a fractional-accuracy pitch cycle, and outputs this to the Fractional Pitch Cycle Adaptive Sound Source Vector Generator (FPCASSVG) 15.

Next, the Integral Pitch Cycle Searcher (IPCS) 14 calculates integral pitch cycle selection measure DIST (T-int) from adaptive sound source vector p (t-int) that has integral pitch cycle T-int, combining filter impulse response matrix H, and target vector X.

Equation (1) is the equation for calculating integral pitch cycle selection measure DIST (T-int).

$$DIST(T-int) = \frac{[xHp(T-int)]^2}{|Hp(T-int)|^2} \quad (T-int = 32, 33, \ldots, 267) \qquad \text{Equation (1)}$$

When calculating integral pitch cycle selection measure DIST (T-int), matrix H', obtained by multiplying combining filter impulse response matrix H by auditory weighting filter impulse response matrix W, may be used in Equation (1) instead of combining filter impulse response matrix H.

Here, the Integral Pitch Cycle Searcher (IPCS) 14 repeatedly executes integral pitch cycle selection measure DIST (T-int) calculation processing using Equation (1) for 236 variations of pitch cycle T-int from pitch cycle 32 to 267 indicated by the Pitch Cycle Indicator (PCI) 11.

The Integral Pitch Cycle Searcher (IPCS) 14 also selects the DIST (T-int) with the largest value from the 236 calculated integral pitch cycle selection measures DIST (T-int), and outputs the selected DIST (T-int) to the Distortion Comparator (DC) 17. In addition, the Integral Pitch Cycle Searcher (IPCS) 14 outputs an index corresponding to adaptive sound source vector pitch cycle T-int, referenced when calculating DIST (T-int), to the Distortion Comparator (DC) 17 as IDX (INT).

Next, the Fractional Pitch Cycle Adaptive Sound Source Vector Generator (FPCASSVG) 15 finds adaptive sound source vector p (T-frac) that has fractional-accuracy pitch cycle T-frac (32+½, 33+½, . . . , 51+½) by a product-sum operation on the adaptive sound source vector received from the Adaptive Sound Source Vector Generator (ASSVG) 13 and a SYNC function, and outputs this p (T-frac) to the Fractional Pitch Cycle Searcher (FPCS) 16.

The Fractional Pitch Cycle Searcher (FPCS) 16 then calculates fractional pitch cycle selection measure DIST (T-frac) from the adaptive sound source vector p (T-frac) that has fractional pitch cycle T-frac, combining filter impulse response matrix H, and target vector X. Equation (2) is the equation for calculating fractional pitch cycle selection measure DIST (T-frac).

$$DIST(T-frac) = \frac{[xHP(T-frac)]^2}{|Hp(T-frac)|^2} \quad \text{Equation (2)}$$

$$\left(T-frac = 32+\frac{1}{2}, 33+\frac{1}{2}, \ldots, 51+\frac{1}{2}\right)$$

When calculating fractional pitch cycle selection measure DIST (T-frac), matrix H', obtained by multiplying combining filter impulse response matrix H by auditory weighting filter impulse response matrix W, may be used in Equation (2) instead of combining filter impulse response matrix H.

Here, the Fractional Pitch Cycle Searcher (FPCS) 16 repeatedly executes fractional pitch cycle selection measure DIST (T-frac) calculation processing using Equation (2) for 20 variations of fractional pitch cycle T-frac from pitch cycle 32+½ to 51+½.

The Fractional Pitch Cycle Searcher (FPCS) 16 also selects the DIST (T-frac) with the largest value from the 20 calculated fractional pitch cycle selection measures DIST (T-frac), and outputs the selected DIST (T-frac) to the Distortion Comparator (DC) 17.

In addition, the Fractional Pitch Cycle Searcher (FPCS) 16 outputs an index corresponding to adaptive sound source vector pitch cycle T-frac, referenced when calculating DIST (T-frac), to the Distortion Comparator (DC) 17 as IDX (FRAC).

Next, the Distortion Comparator (DC) 17 compares the values of DIST (INT) received from the Integral Pitch Cycle Searcher (IPCS) 14 and DIST (FRAC) received from the Fractional Pitch Cycle Searcher (FPCS) 16. Then the Distortion Comparator (DC) 17 determines the pitch cycle when pitch cycle selection measure DIST with the larger value of DIST (INT) and DIST (FRAC) is calculated as the optimal pitch cycle, and outputs the index corresponding to the optimal pitch cycle as optimal index IDX.

When, as in the above example, an integral-accuracy pitch cycle search range from 32 to 267, and a fractional-accuracy pitch cycle search range from 32+½ to 51+½, are selected as the pitch cycle search ranges, a total of 256 (256=236+20) integral-accuracy and fractional-accuracy pitch cycle search candidates are provided, and optimal index IDX is coded as 8-bit binary data.

The above-described "linear predictive residual pitch cycle search apparatus using an adaptive code book" is characterized by both performing a pitch cycle search at integral accuracy and performing a ½ fractional-accuracy pitch cycle search in a section corresponding to a shorter pitch cycle than the pitch cycle search range at integral accuracy, and performing selection of a final pitch cycle from the optimal pitch cycle retrieved at integral accuracy and the optimal pitch cycle retrieved at fractional accuracy.

Thus, with a conventional pitch search apparatus, linear predictive residual pitch cycles can be encoded/decoded efficiently for a female voice, which contains many comparatively short pitch cycles. The above characteristic and effect are disclosed in Document 2 (IEEE JOURNAL ON SELECTED AREAS IN COMMUNICATIONS, pp. 31-pp. 41, VOL. 13, No. 1, JANUARY 1995), etc.

However, with a conventional pitch search apparatus, the range for searching for a pitch cycle at fractional accuracy is limited to short pitch cycles, and therefore, for a male voice, which contains many comparatively long pitch cycles, pitch cycles are searched for outside the range in which pitch cycles are searched for at fractional accuracy, and pitch cycles are searched for at integral accuracy only, with a resultant problem that pitch cycle resolution falls, and it is difficult to perform encoding/decoding efficiently.

DISCLOSURE OF INVENTION

It is an object of the present invention to provide a pitch search apparatus that enables speech signal pitch cycles to be encoded/decoded efficiently.

This object is achieved by not fixing the range of pitch cycles searched for at fractional accuracy, but searching at fractional accuracy in the vicinity of a pitch cycle retrieved in the previous subframe.

BEST MODE FOR CARRYING OUT THE INVENTION

With reference now to the accompanying drawings, embodiments of the present invention will be explained in detail below.

EMBODIMENT 1

Figure 1:
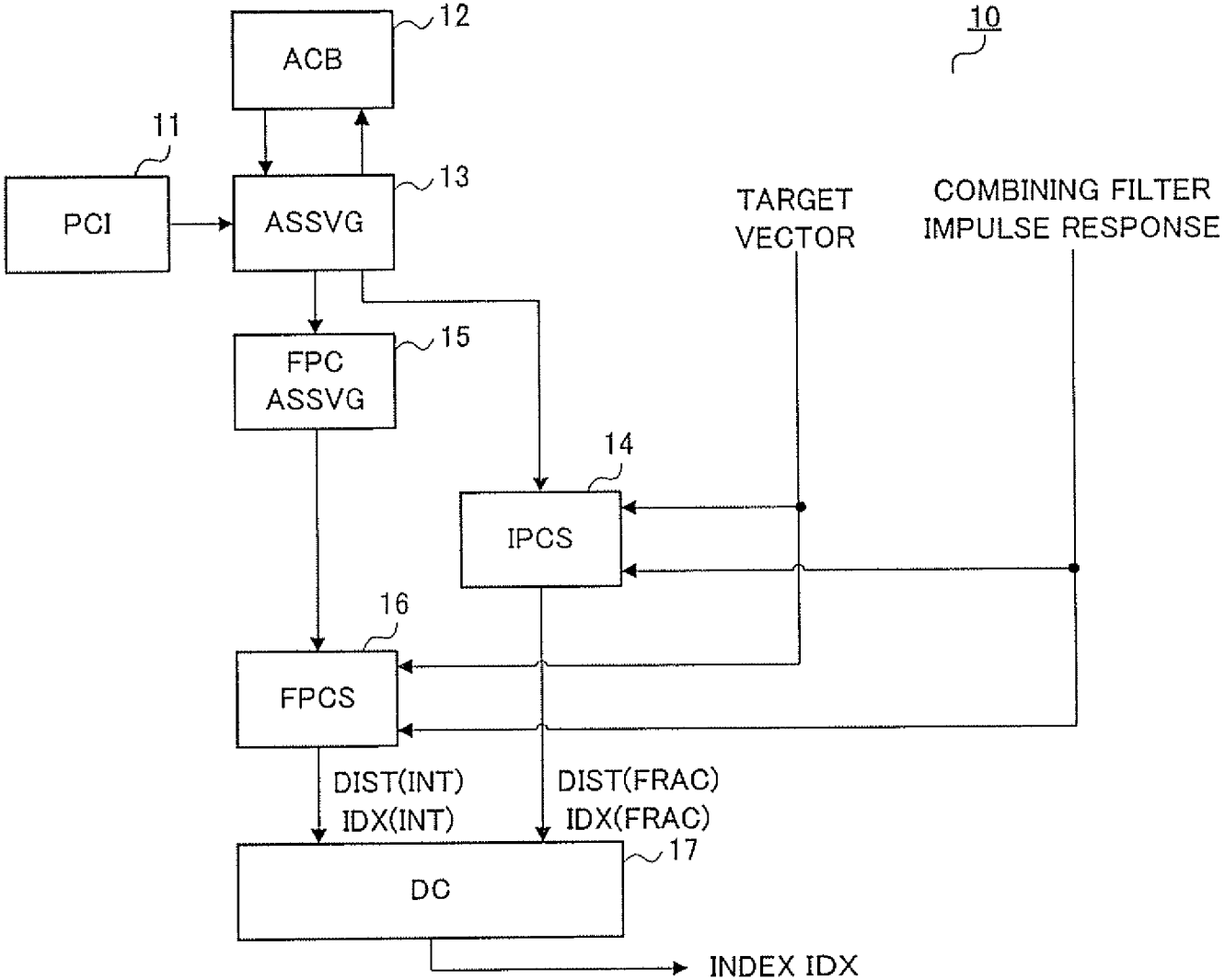
FIG. 1 is a block diagram showing the configuration of a conventional pitch cycle search apparatus.
Figure 2:
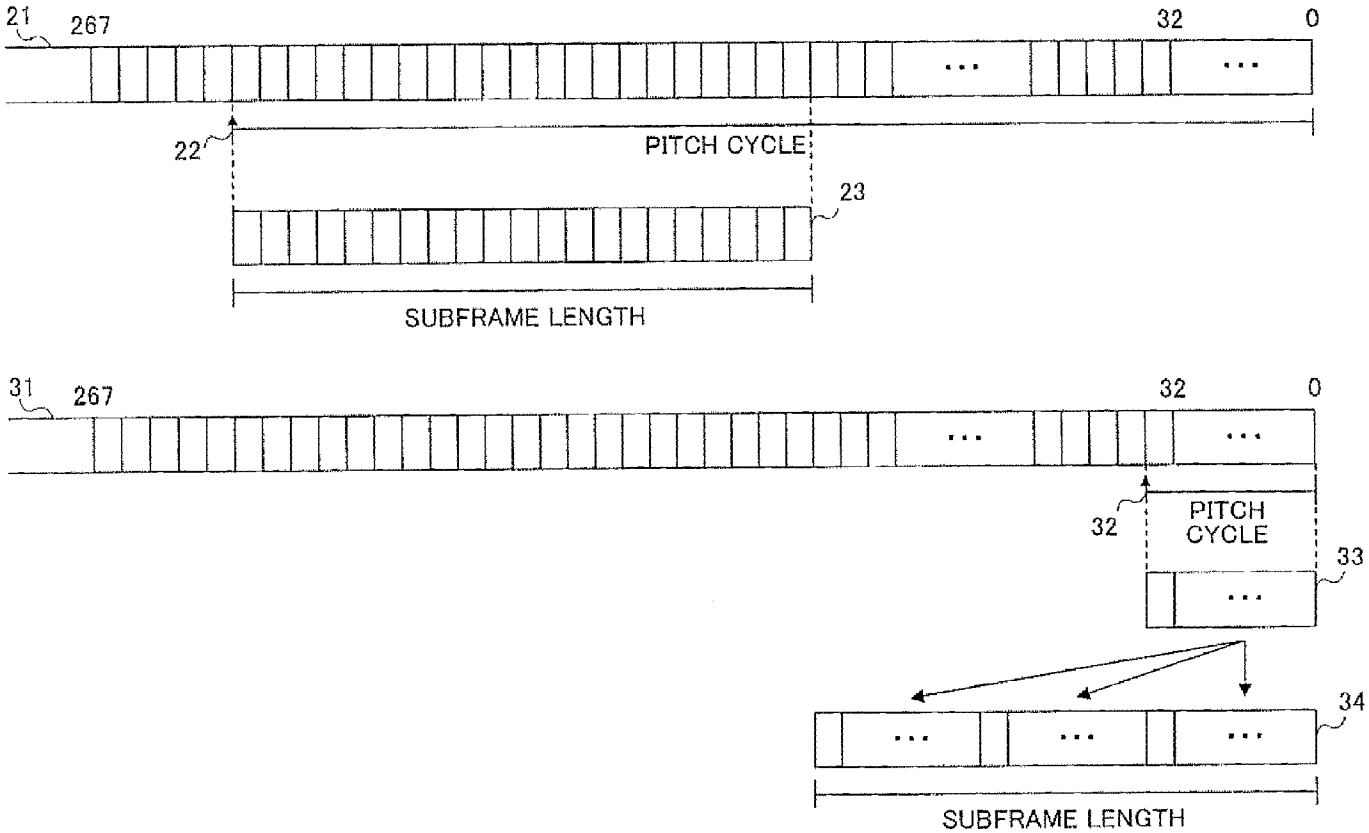
FIG. 2 is a drawing showing an example of frame configuration.
Figure 3:
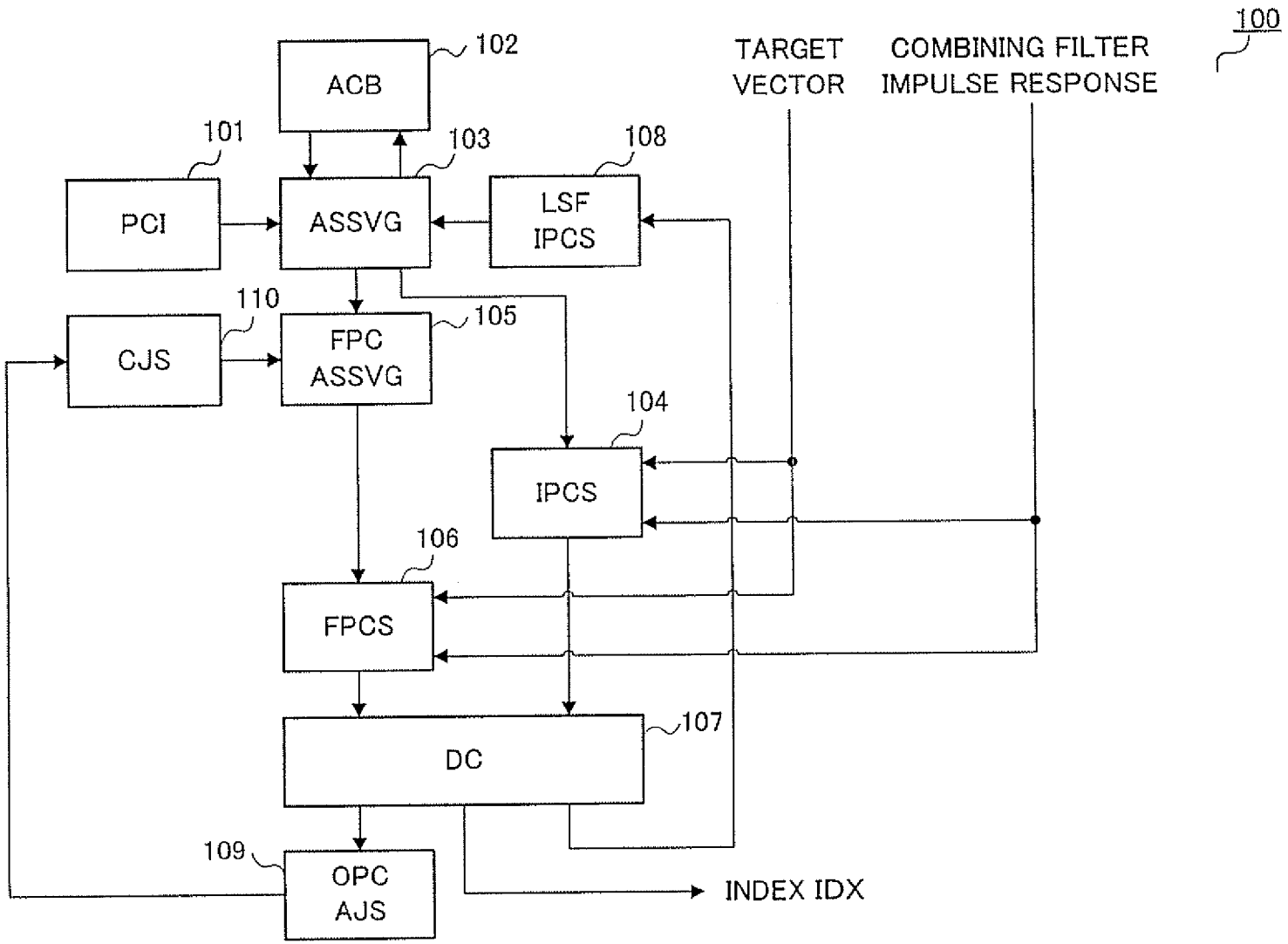
FIG. 3 is a block diagram showing the configuration of a pitch cycle search apparatus according to Embodiment 1 of the present invention.

FIG. 3 is a block diagram showing the configuration of a pitch cycle search apparatus according to Embodiment 1 of the present invention. The pitch cycle search apparatus 100 in FIG. 3 is mainly composed of a Pitch Cycle Indicator (PCI) 101, Adaptive Code Book (ACB) 102, Adaptive Sound Source Vector Generator (ASSVG) 103, Integral Pitch Cycle Searcher (IPCS) 104, Fractional Pitch Cycle Adaptive Sound Source Vector Generator (FPCASSVG) 105, Fractional Pitch Cycle Searcher (FPCS) 106, Distortion Comparator (DC) 107, Last Sub Frame Integral Pitch Cycle Storage (LSFIPCS) 108, Optimal Pitch Cycle Accuracy Judge Section (OPCAJS) 109, and Comparison Judge Section (CJS) 110.

The Pitch Cycle Indicator (PCI) 101 sequentially indicates to the Adaptive Sound Source Vector Generator (ASSVG) 103 pitch cycles T-int within a preset pitch cycle search range. The Adaptive Code Book (ACS) 102 stores drive sound source signals generated in the past.

The Adaptive Sound Source Vector Generator (ASSVG) 103 extracts from the Adaptive Code Book (ACB) 102 the adaptive sound source vector p (t-int) that has integral-accuracy pitch cycle T-int in accordance with a directive received from the Pitch Cycle Indicator (PCI) 101, and outputs this adaptive sound source vector p (t-int) to the Integral Pitch Cycle Searcher (IPCS) 104.

The Adaptive Sound Source Vector Generator (ASSVG) 103 reads integral-accuracy pitch cycle T0 selected in the previous subframe from the Last Sub Frame Integral Pitch Cycle Storage (LSFIPCS) 108, sets preceding and succeeding pitch cycles centered on this pitch cycle T0 as a range for searching for a fractional-accuracy pitch frequency, extracts adaptive sound source vector p(T-frac) that has fractional-accuracy pitch cycle T-frac within this range from the Adaptive Code Book (ACB) 102, and outputs the extracted adaptive sound source vector to the Fractional Pitch Cycle Adaptive Sound Source Vector Generator (FPCASSVG) 105.

The Integral Pitch Cycle Searcher (IPCS) 104 calculates integral pitch cycle selection measure DIST (T-int) from adaptive sound source vector p(t-int) received from the Adaptive Sound Source Vector Generator (ASSVG) 103, combining filter impulse response matrix H, and target vector x. The Integral Pitch Cycle Searcher (IPCS) 104 then selects the DIST (T-int) with the largest value from the integral pitch cycle selection measures DIST (T-int), and outputs the selected DIST (T-int) to the Distortion Comparator (DC) 107.

The Fractional Pitch Cycle Adaptive Sound Source Vector Generator (FPCASSVG) 105 finds adaptive sound source vector p(T-trac) that has fractional-accuracy pitch cycle T-frac (T-frac=T0−10+½, T0−9+½, . . . , T0+9+½) by a product-sum operation on the adaptive sound source vector received from the Adaptive Sound Source Vector Generator (ASSVG) 103 and a SYNC function, and outputs this p(T-frac) to the Fractional Pitch Cycle Searcher (FPCS) 106.

The Fractional Pitch Cycle Searcher (FPCS) 106 calculates fractional pitch cycle selection measure DIST(T-frac) from adaptive sound source vector p(T-frac) received from the Fractional Pitch Cycle Adaptive Sound Source Vector Generator (FPCASSVG) 105, combining filter impulse response matrix H, and target vector x. The Fractional Pitch Cycle Searcher (FPCS) 106 then selects the DIST(T-frac) with the largest value from the fractional pitch cycle selection measures DIST(T-frac) and outputs the selected DIST(T-frac) to the Distortion Comparator (DC) 107.

The Distortion Comparator (DC) 107 compares the values of DIST(INT) received from the Integral Pitch cycle Searcher (IPCS) 104 and DIST(FRAC) received from the Fractional Pitch Cycle Searcher (FPCS) 106. Then the Distortion Comparator (DC) 107 determines the pitch cycle when pitch cycle selection measure DIST with the larger value of DIST(INT) and DIST(FRAC) is calculated as the optimal pitch cycle, and outputs the index, of IDX(INT) and IDX(FRAC), corresponding to the optimal pitch cycle as optimal index IDX.

Then the Distortion Comparator (DC) 107 outputs optimal pitch cycle integral component T0 to the Last Sub Frame Integral Pitch Cycle Storage (LSFIPCS) 10, and outputs the optimal pitch cycle to the Optimal Pitch Cycle Accuracy Judge Section (OPCAJS) 109.

The Last Sub Frame Integral Pitch Cycle Storage (LSFIPCS) 108 stores integral component T0 of the optimal pitch cycle selected by the Distortion Comparator (DC) 107, and when a pitch cycle of the next subframe is searched for, outputs this optimal pitch cycle integral component T0 to the Adaptive Sound Source Vector Generator (ASSVG) 103.

The Optimal Pitch Cycle Accuracy Judge Section (OPCAJS) 109 judges whether the optimal pitch cycle is of integral accuracy or fractional accuracy. The Comparison Judge Section (CJS) 110 restricts the number of times fractional-accuracy pitch information is selected in an optimal pitch cycle.

Figure 4:
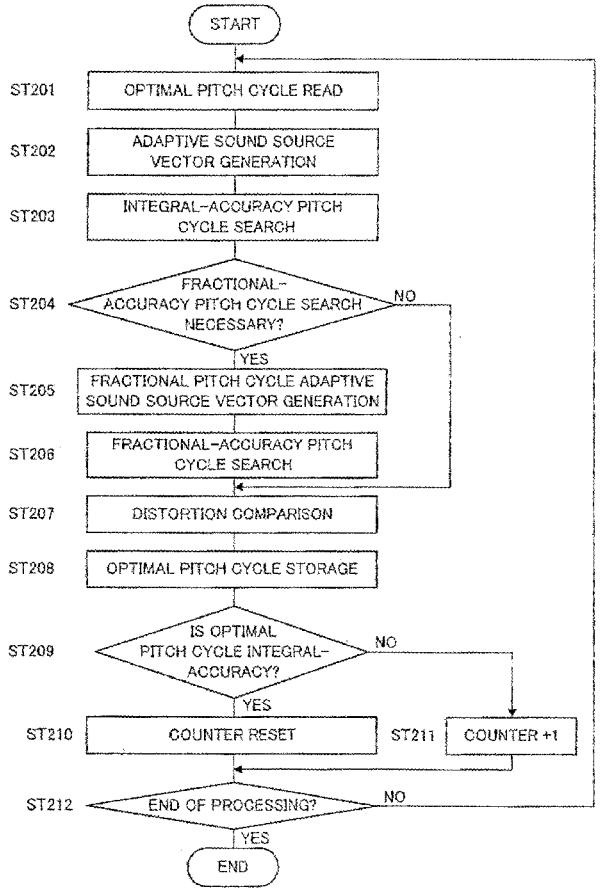
FIG. 4 is a flowchart showing an example of the operation of a pitch cycle search apparatus of this embodiment.

Next, the operation of a pitch cycle search apparatus 100 according to this embodiment will be described. FIG. 4 is a flowchart showing an example of the operation of a pitch cycle search apparatus of this embodiment.

In FIG. 4, in step (hereinafter referred to as "ST") 201, the integral-accuracy pitch cycle T0 selected in the previous subframe is read from the Last Sub Frame Integral Pitch Cycle Storage (LSFIPCS) 10 by the Adaptive Sound Source Vector Generator (ASSVG) 103.

In ST202, an adaptive sound source vector is generated by the Adaptive Sound Source Vector Generator (ASSVG) 103. In ST203, optimal integral-accuracy pitch cycle T-int is searched for by the Integral Pitch Cycle Searcher (IPCS) 104.

In ST204, the Comparison Judge Section (CJS) 110 judges whether or not a fractional-accuracy pitch cycle search is necessary. If a fractional-accuracy pitch cycle search is necessary, the processing flow proceeds to ST205. If a fractional-accuracy pitch cycle search is not necessary, the processing flow proceeds to ST207.

In ST205, an adaptive sound source vector that has fractional-accuracy pitch cycle T-trac is generated by the Fractional Pitch Cycle Adaptive Sound Source Vector Generator (FPCASSVG) 105. In ST206, the optimal fractional-accuracy pitch cycle T-frac is searched for by the Fractional Pitch Cycle Searcher (FPCS) 106

In ST207, the optimal pitch cycle is selected by the Distortion Comparator (DC) 107 from optimal integral-accuracy pitch cycle T-int and optimal fractional-accuracy pitch cycle T-frac. In ST208, integral component T0 of the optimal pitch cycle selected by the Distortion Comparator (DC) 107 is stored in the Last Sub Frame Integral Pitch Cycle Storage (LSFIPCS) 108.

In ST209, the Optimal Pitch Cycle Accuracy Judge Section (OPCAJS) 109 judges whether the optimal pitch cycle selected by the Distortion Comparator (DC) 107 is an integral-accuracy pitch cycle or a fractional-accuracy pitch cycle.

In ST210, a counter indicating the number of times a fractional-accuracy pitch cycle has been selected as the optimal pitch cycle is reset to 0 by the Comparison Judge Section (CJS) 110. In ST211, the counter indicating the number of times a fractional-accuracy pitch cycle has been selected as the optimal pitch cycle is incremented by 1 by the Comparison Judge Section (CJS) 110.

In ST212, if pitch cycle search apparatus 100 processing has not finished, the processing flow returns to ST201.

Detailed operations are described below for an example in which a pitch cycle search apparatus 100 with the above-described configuration has an 8-bit-sized adaptive code book, and performs target pitch cycle searching, in a CELP speech encoding/decoding apparatus that performs encoding/decoding of a 16 kHz speech signal.

The Pitch Cycle Indicator (PCI) 101 sequentially indicates to the Adaptive Sound Source Vector Generator (ASSVG) 103 pitch cycles T-int within a preset pitch cycle search range. For example, when the target vector pitch cycle search range is preset from 32 to 267 at integral accuracy, and from 32+½ to 51+½ at fractional accuracy in a CELP speech encoding/decoding apparatus that performs encoding and decoding of a speech signal with a 16 kHz sampling frequency, the Pitch Cycle Indicator (PCI) 101 outputs pitch cycles T-int (T-int=32, 33, . . . , 267) sequentially to the Adaptive Sound Source Vector Generator (ASSVG) 103.

Next, the Adaptive Sound Source Vector Generator (ASSVG) 103 extracts from the Adaptive Code Book (ACB) 102 the adaptive sound source vector p (t-int) that has integral-accuracy pitch cycle T-int in accordance with a directive received from the Pitch Cycle Indicator (PCI) 101, and outputs this adaptive sound source vector p(t-int) to the Integral Pitch Cycle Searcher (IPCS) 104.

The Adaptive Sound Source Vector Generator (ASSVG) 103 reads integral-accuracy pitch cycle T0 selected in the previous subframe from the Last Sub Frame Integral Pitch Cycle Storage (LSFIPCS) 108, sets preceding and succeeding pitch cycles centered on this pitch cycle T0 as a range for searching for a fractional-accuracy pitch frequency, extracts adaptive sound source vector p(T-frac) that has fractional-accuracy pitch cycle T-frac within this range from the Adaptive Code Book (ACE) 102, and outputs the extracted adaptive sound source vector to the Fractional Pitch Cycle Adaptive Sound Source Vector Generator (FPCASSVG) 105.

Specifically, the Adaptive Sound Source Vector Generator (ASSVG) 103 sets 20 pitch cycles T-frac centered on integral component T0 (T-frac=T0−10+½, T0−9+½, . . . , T0+9+½), and extracts adaptive sound source vector p(T-frac) that has these pitch cycles from the Adaptive Code Book (ACB) 102.

Then , using Equation (3) shown below, the Integral Pitch Cycle Searcher (IPCS) 104 calculates integral pitch cycle selection measure DIST(T-int) from adaptive sound source vector p(t-int) received from the Adaptive Sound Source Vector Generator (ASSVG) 103, combining filter impulse response matrix H, and target vector x.

$$DIST(T-int) = \frac{[xHP(T-int)]^2}{|Hp(T-int)|^2} \quad \text{Equation (3)}$$

$$(T-int = 32, 33, \ldots, 267)$$

Here, the Integral Pitch Cycle Searcher (IPCS) 104 repeatedly executes integral pitch cycle selection measure DIST(T-int) calculation processing using Equation (3) for 236 variations of pitch cycle T-int from pitch cycle 32 to 267 indicated by the Pitch Cycle Indicator (PCI) 101.

The Integral Pitch Cycle Searcher (IPCS) 104 also selects the DIST(T-int) with the largest value from the 236 calculated integral pitch cycle selection measures DIST(T-int), and outputs the selected DIST(T-int) to the Distortion Comparator (DC) 107. In addition, the Integral Pitch Cvcle Searcher (IPCS) 104 outputs an index corresponding to adaptive sound source vector pitch cycle T-int, referenced when calculating DIST(T-int), to the Distortion Comparator (DC) 107 as IDX (INT).

Next, the Fractional Pitch Cycle Adaptive Sound Source Vector Generator (FPCASSVG) 105 finds adaptive sound source vector p(T-frac) that has fractional-accuracy pitch cycle T-frac (T-frac=T0−10+½, T0−9+½, . . . , T0+9+½) by a product-sum operation on the adaptive sound source vector received from the Adaptive Sound Source Vector Generator (ASSVG) 103 and a SYNC function, and outputs this p(T-frac) to the Fractional Pitch Cycle Searcher (FPCS) 106.

The Fractional Pitch Cycle Searcher (FPCS) 106 then calculates fractional pitch cycle selection measure DIST(T-frac) from the adaptive sound source vector p(T-frac) that has fractional pitch cycle T-frac, combining filter impulse response matrix H, and target vector X. Equation (4) is the equation for calculating fractional pitch cycle selection measure DIST(T-frac)

$$DIST(T-frac) = \frac{[xHP(T-frac)]^2}{|Hp(T-frac)|^2} \quad \text{Equation (4)}$$

$$(T-frac = T0-10+1/2, T0-9+1/2, c, T0+9+1/2)$$

Here, the Fractional Pitch Cycle Searcher (FPCS) 106 repeatedly executes fractional pitch cycle selection measure DIST(T-frac) calculation processing using Equation (4) for 20 variations of fractional pitch cycle T-frac from pitch cycle T0−10+½ to T0+9+½.

The Fractional Pitch Cycle Searcher (FPCS) 106 then selects the DIST(T-frac) with the largest value from the 20 calculated fractional pitch cycle selection measures DIST(T-frac), and outputs the selected DIST(T-frac) to the Distortion Comparator (DC) 107. In addition, the Fractional Pitch Cycle Searcher (FPCS) 106 outputs an index corresponding to adaptive sound source vector pitch cycle T-frac, referenced when calculating DIST(T-frac), to the Distortion Comparator (DC) 107 as IDX(FRAC).

Next, the Distortion Comparator (DC) 107 compares the values of DIST(INT) received from the Integral Pitch Cycle Searcher (IPCS) 104 and DIST(FRAC) received from the Fractional Pitch Cycle Searcher (FPCS) 106. Then the Distortion Comparator (DC) 107 determines the pitch cycle when pitch cycle selection measurement DIST with the larger value of DIST(INT) and DIST(FRAC) is calculated as the optimal pitch cycle, and outputs the index, of IDX(INT) and IDX(FRAC), corresponding to the optimal pitch cycle as optimal index IDX.

Then the Distortion Comparator (DC) 107 outputs optimal pitch cycle integral component T0 to the Last Sub Frame Integral Pitch Cycle Storage (LSFIPCS) 108, and outputs the optimal pitch cycle to the Optimal Pitch Cycle Accuracy Judge Section (OPCAJS) 109.

When, as in the above example, an integral-accuracy pitch cycle search range from 32 to 267, and a fractional-accuracy pitch cycle search range from T0−10+½ to T0+9+½, are selected as the pitch cycle search ranges, a total of 256

(256=236+20) integral-accuracy and fractional-accuracy pitch cycle search candidates are provided, and optimal index IDX is coded as 8-bit binary data.

The Last Sub Frame Integral Pitch Cycle Storage (LSFIPCS) 108 stores integral component T0 of the optimal pitch cycle selected by the Distortion Comparator (DC) 107, and when a pitch cycle of the next sub frame is searched for, outputs this optimal pitch cycle integral component T0 to the Adaptive Sound Source Vector Generator (ASSVG) 103.

The Optimal Pitch Cycle Accuracy Judge Section (OPCAJS) 109 judges whether the optimal pitch cycle is of integral accuracy or fractional accuracy. When the optimal pitch cycle is of integral accuracy, the Optimal Pitch Cycle Accuracy Judge Section (OPCAJS) 109 resets the Comparison Judge Section (CJS) 110 counter to 0. When the optimal pitch cycle is of fractional accuracy, the Optimal Pitch Cycle Accuracy Judge Section (OPCAJS) 109 adds 1 to the Comparison Judge Section (CJS) 110 counter.

Specifically, the Comparison Judge Section (CJS) 110 is provided with a counter that indicates the number of times a fractional-accuracy pitch cycle has been selected as the optimal pitch cycle, and compares the counter value with a preset non-negative integer N. If the counter value is greater than integer N, the Comparison Judge Section (CJS) 110 outputs a directive to the Fractional Pitch Cycle Adaptive Sound Source Vector Generator (FPCASSVG) 105 indicating that a fractional-accuracy pitch cycle is not to be performed. If the counter value is less than or equal to integer N, the Comparison Judge Section (CJS) 110 outputs a directive to the Fractional Pitch Cycle Adaptive Sound Source Vector Generator (FPCASSVG) 105 indicating that a fractional-accuracy pitch cycle is to be performed.

Thus, according to a pitch cycle search apparatus of this embodiment, by not fixing the range of pitch cycles searched for at fractional accuracy, but searching at fractional accuracy in the vicinity of a pitch cycle retrieved in the previous subframe, it is possible for pitch cycle searching to be carried out with high resolution even for speech signals with long pitch cycles or for speech signal linear predictive residuals.

Also, according to a pitch cycle search apparatus of this embodiment, by searching at fractional accuracy in the vicinity of a pitch cycle retrieved in the previous subframe, it is possible to improve search accuracy for speech signal linear predictive residuals, despite the shortness of pitch cycles, and to perform high-quality speech encoding and decoding.

In the above description, an example has been described in which a linear predictive residual pitch cycle is searched for using an adaptive code book, but the object of a pitch cycle search is not limited to a linear predictive residual, and this embodiment can be applied to any speech signal information that has a pitch cycle.

Furthermore, in the above description, when calculating a pitch cycle selection measure, an integral-accuracy pitch cycle search and fractional-accuracy pitch cycle search have been described using a closed-loop search procedure, but this is not a limitation, and similar results can be achieved with any procedure in which an integral-accuracy pitch cycle search and fractional-accuracy pitch cycle search are performed, and the integral-accuracy pitch cycle and fractional-accuracy pitch cycle are compared.

For example, if a two-stage (open-loop and closed-loop) pitch cycle search is carried out using the above-described configuration, a Distortion Comparator (DC) 107 that includes the Integral Pitch Cycle Searcher (IPCS) 104 and Fractional Pitch Cycle Searcher (FPCS) 106 is configured, an adaptive sound source vector that has an integral-accuracy pitch cycle received from the Adaptive Sound Source Vector Generator (ASSVG) 103 and an adaptive sound source vector that has a fractional-accuracy pitch cycle received from the Fractional Pitch Cycle Adaptive Sound Source Vector Generator (FPCASSVG) 105 are used, and indexing corresponding to the optimal pitch cycle of the subframe to be processed is performed by means of a procedure divided into two stages, an open-loop search and closed-loop search, in the Distortion Comparator (DC) 107.

Moreover, in the above description, the pitch cycle search range has been taken to be 32 to 267, but there is no particular limitation on the pitch cycle search range, and similar results to those in the above description can be obtained as long as the fractional-accuracy pitch cycle search range is not fixed.

Also, in the above description, the fractional-accuracy pitch cycle search range has been taken as 20 pitch cycles T-frac centered on integral-accuracy pitch cycle T0 (T-frac=T0−10+½, T0−9+½, . . . , T0+9+½), but there is no particular limitation on the pitch cycle range, and any range set based on the integral-accuracy pitch cycle may be used.

Furthermore, a description has been given in which the maximum number of times the optimal pitch cycle is selected with fractional-accuracy is a fixed value N, but this value N may also be increased or decreased adaptively according to the communication environment.

Moreover, in-the above description, the number of times a fractional-accuracy pitch cycle is selected is limited to N consecutive times, but it is also possible for N to be set to infinitude, and for the number of times a fractional-accuracy pitch cycle is selected to be made infinite. In particular, if it is not necessary to consider the occurrence of an error when transmitting a pitch cycle index-for example, when coding information including this pitch cycle index is written to a storage medium-the results of a pitch cycle search can be encoded with high resolution, without a limit on the number of fractional-accuracy pitch cycle selections, by making the number of times a fractional-accuracy pitch cycle is selected infinite.

Furthermore, in the above description, an example has been described in which a pitch cycle search is not performed at fractional accuracy when the number of times a fractional-accuracy pitch cycle is selected exceeds a predetermined limit, but this is not a limitation, and a fractional-accuracy pitch cycle search may also be carried out in a predetermined range-for example, from 32+½ to 51+½ when the number of times a fractional-accuracy pitch cycle is selected exceeds the predetermined limit.

By performing a fractional-accuracy pitch cycle search when the number of times a fractional-accuracy pitch cycle is selected exceeds a predetermined limit in this way, it is possible to encode the results of a pitch cycle search with high resolution even if an error occurs when a pitch cycle index is transmitted.

In the above description, when calculating integral pitch cycle selection measure DIST(T-int) or DIST(T-frac), matrix H', obtained by multiplying combining filter impulse response matrix H by auditory weighting filter impulse response matrix W, may be used instead of combining filter impulse response matrix H.

EMBODIMENT 2

Figure 5:
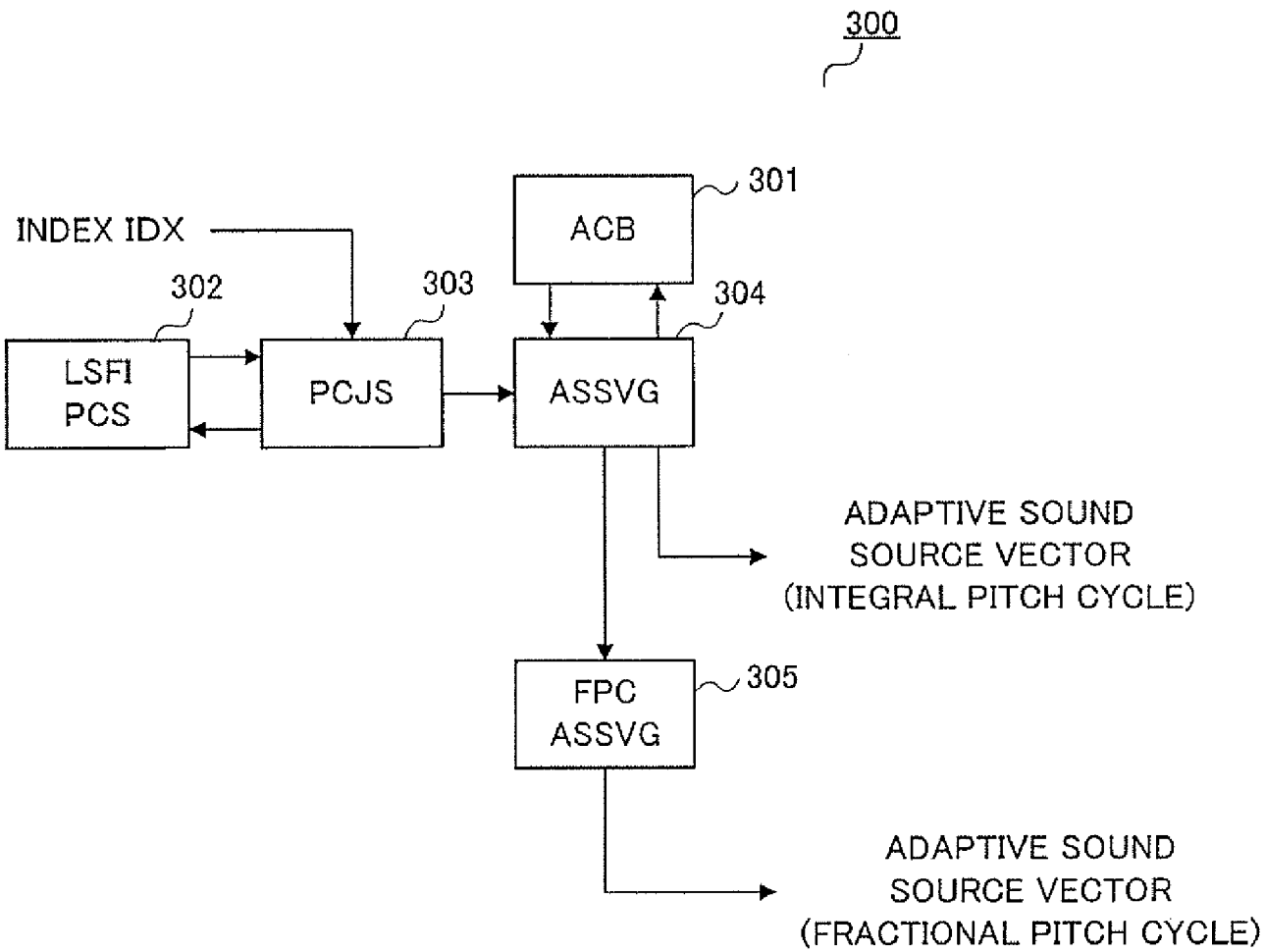
FIG. 5 is a block diagram showing the configuration of a decoding adaptive sound source vector generation apparatus according to Embodiment 2 of the present invention.

FIG. 5 is a block diagram showing the configuration of a decoding adaptive sound source vector generation apparatus according to Embodiment 2 of the present invention.

The decoding adaptive sound source vector generation apparatus 300 in FIG. 5 is mainly composed of an Adaptive Code Book 301 (ACS), Last Sub Frame Integral Pitch Cycle Storage (LSFIPCS) 302, Pitch Cycle Judge Section (PCJS) 303, Adaptive Sound Source Vector Generator (ASSVG) 304, and Fractional Pitch Cycle Adaptive Sound Source Vector Generator (FPCASSVG) 305.

The Adaptive Code Book 301 (ACB) stores drive sound source signals generated in the past.

The Last Sub Frame Integral Pitch Cycle Storage (LSFIPCS) 302 receives integral component T0 of a pitch cycle judged by the Pitch Cycle Judge Section (PCJS) 303, stores this T0, and when the next subframe is processed, outputs this T0 to the Pitch Cycle Judge Section (PCJS) 303.

The Pitch Cycle Judge Section (PCJS) 303 judges whether a pitch cycle corresponding to index IDX is of integral accuracy or fractional accuracy. The Pitch Cycle Judge Section (PCJS) 303 then sets the pitch cycle using index IDX transmitted from the encoding side and integral component T0 of the pitch cycle selected in the previous subframe.

If, for example, received index IDX indicates an integral-accuracy pitch cycle, the Pitch Cycle Judge Section (PCJS) 303 conveys the pitch cycle corresponding to index IDX to the Adaptive Sound Source Vector Generator (ASSVG) 304.

If received index IDX indicates a fractional-accuracy pitch cycle, the Pitch Cycle Judge Section (PCJS) 303 finds the pitch cycle from information on the pitch cycle corresponding to index IDX and pitch cycle integral component T0 for the previous subframe, and conveys the obtained pitch cycle to the Adaptive Sound Source Vector Generator (ASSVG) 304. Specifically, the Pitch Cycle Judge Section (PCJS) 303 finds a value corresponding to index IDX from the fractional-accuracy pitch cycle range (−10+½, −9+½, . . . , 9+½), and takes the result of adding T0 to this value as the fractional-accuracy pitch cycle.

The Pitch Cycle Judge Section (PCJS) 303 is also provided with a counter that counts the number of times the pitch cycle corresponding to index IDX is a fractional-accuracy pitch cycle.

When, for example, the pitch cycle corresponding to index IDX is of fractional accuracy, the Pitch Cycle Judge Section (PCJS) 303 adds 1 to the counter. When the pitch cycle corresponding to index IDX is of integral accuracy, the Pitch Cycle Judge Section (PCJS) 303 resets the counter to 0.

When the pitch cycle is of integral accuracy, the Adaptive Sound Source Vector Generator (ASSVG) 304 extracts from the Adaptive Code Book 301 (ACB) the adaptive sound source vector p(T-int) that has pitch cycle T-int in accordance with a directive received from the Pitch Cycle Judge Section (PCJS) 303, and outputs adaptive sound source vector p(T-int).

When the pitch cycle is of fractional accuracy, the Adaptive Sound Source Vector Generator (ASSVG) 304 takes from the Adaptive Code Book 301 (ACB) the adaptive sound source vector necessary when extracting adaptive sound source vector p(T-frac) that has pitch cycle T-frac in accordance with a directive received from the Pitch Cycle Judge Section (PCJS) 303, and outputs this to the Fractional Pitch Cycle Adaptive Sound Source Vector Generator (FPCASSVG) 305.

The Fractional Pitch Cycle Adaptive Sound Source Vector Generator (FPCASSVG) 305 finds adaptive sound source vector p(T-frac) that has fractional-accuracy pitch cycle T-frac by a product-sum operation on the adaptive sound source vector received from the Adaptive Sound Source Vector Generator (ASSVG) 304 and a SYNC function, and outputs this as the decoding adaptive sound source vector.

EMBODIMENT 3

In Embodiment 3, an example is described in which a pitch cycle search apparatus according to Embodiment 1 or a decoding adaptive sound source vector generation apparatus according to Embodiment 2 is used for communications installed in a transmitting apparatus and receiving apparatus.

Figure 6:
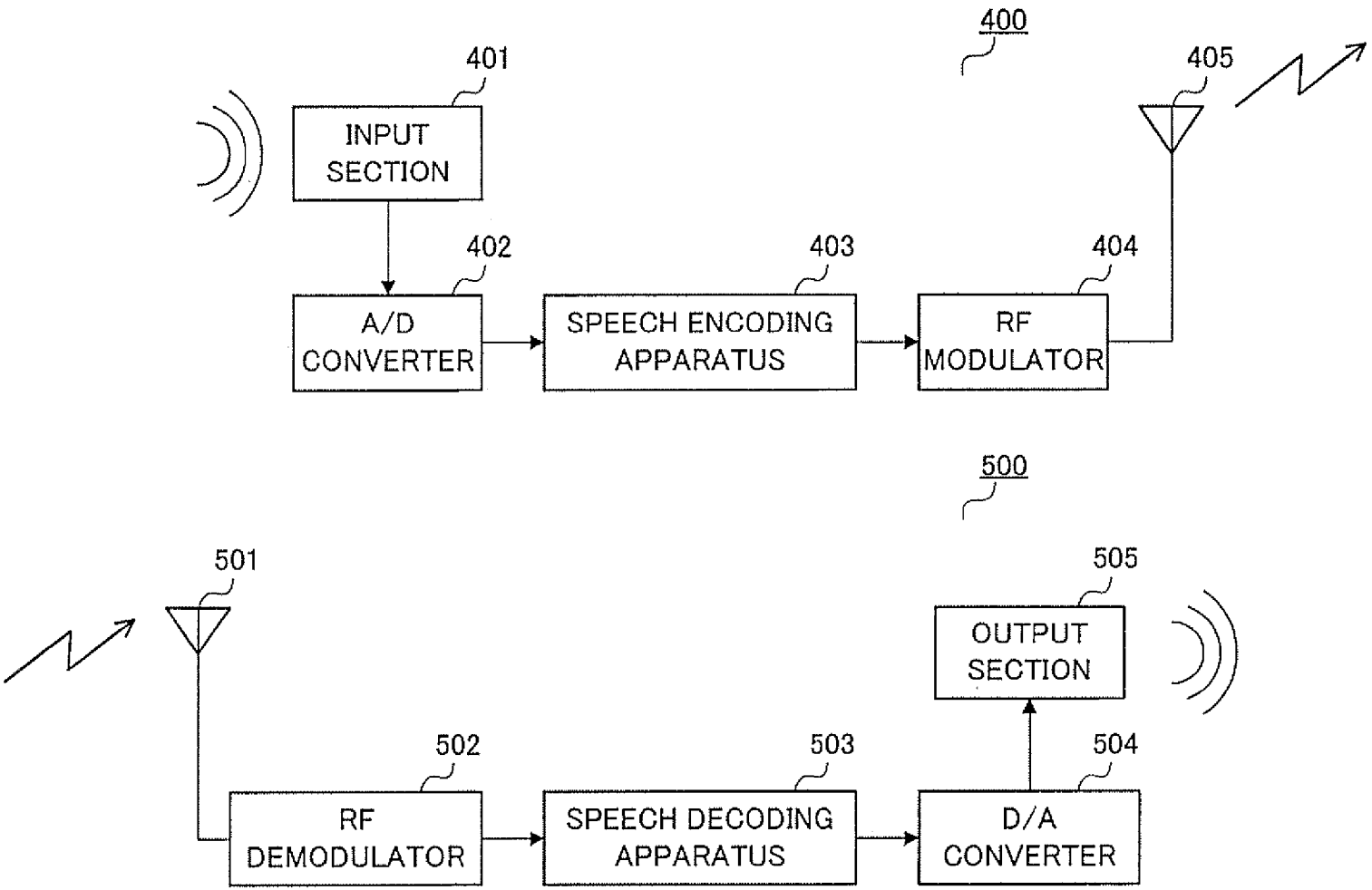
FIG. 6 is a block diagram showing the internal configuration of the speech decoding section 503 in FIG. 4.

FIG. 6 is a block diagram showing the internal configuration of a speech signal transmitting apparatus and receiving apparatus according to Embodiment 3 of the present invention.

The speech signal transmitting apparatus 400 in FIG. 6 is mainly composed of an input section 401, A/D converter 402, speech encoding apparatus 403, RF modulator 404, and transmitting antenna 405. The speech signal receiving apparatus 500 in FIG. 6 is mainly composed of a receiving antenna 501, RF demodulator 502, speech decoding section 503, D/A converter 504, and output section 505.

In FIG. 6, a speech signal is converted to an electrical signal by the input section 401, and is then output to the A/D converter 402. The A/D converter 402 converts the (analog) signal output from the input section 401 to a digital signal, and outputs this signal to the speech encoding apparatus 403. The speech encoding apparatus 403 is provided with a signal processing apparatus according to either of the above-described embodiments, encodes the digital speech signal output from the A/D converter 402 using a speech encoding method described later herein, and outputs encoded information to the RF modulator 404. The RF modulator 404 places the speech encoded information output from the speech encoding apparatus 403 on a propagation medium such as a radio wave, converts the signal for sending, and outputs it to the transmitting antenna 405. The transmitting antenna 405 sends the output signal output from the RF modulator 404 as a radio wave (RF signal).

The RF signal is received by the receiving antenna 501 and output to the RF demodulator 502. The RF signal in the drawing is an RF signal as seen from the receiving side, and, if there is no signal attenuation or noise superimposition in the propagation path, is exactly the same as the transmitted RF signal. The RF demodulator 502 demodulates speech encoded information from the RF signal output from the receiving antenna 501, and outputs this information to the speech decoding section 503. The speech decoding section 503 is provided with a signal processing apparatus according to either of the above-described embodiments, decodes a speech signal from the speech encoded information output from the RF demodulator 502 using a speech decoding method described later herein, and outputs the resulting signal to the D/A converter 504. The D/A converter 504 converts the digital speech signal output from the speech decoding section 503 to an analog electrical signal, and outputs this signal to the output section 505. The output section 505 converts the electrical signal to vibrations of the air, and outputs sound waves that are audible to the human ear.

By providing at least one of the above-described kinds of speech signal transmitting apparatus and receiving apparatus, it is possible to configure a base station apparatus and mobile terminal apparatus in a mobile communication system.

Figure 7:
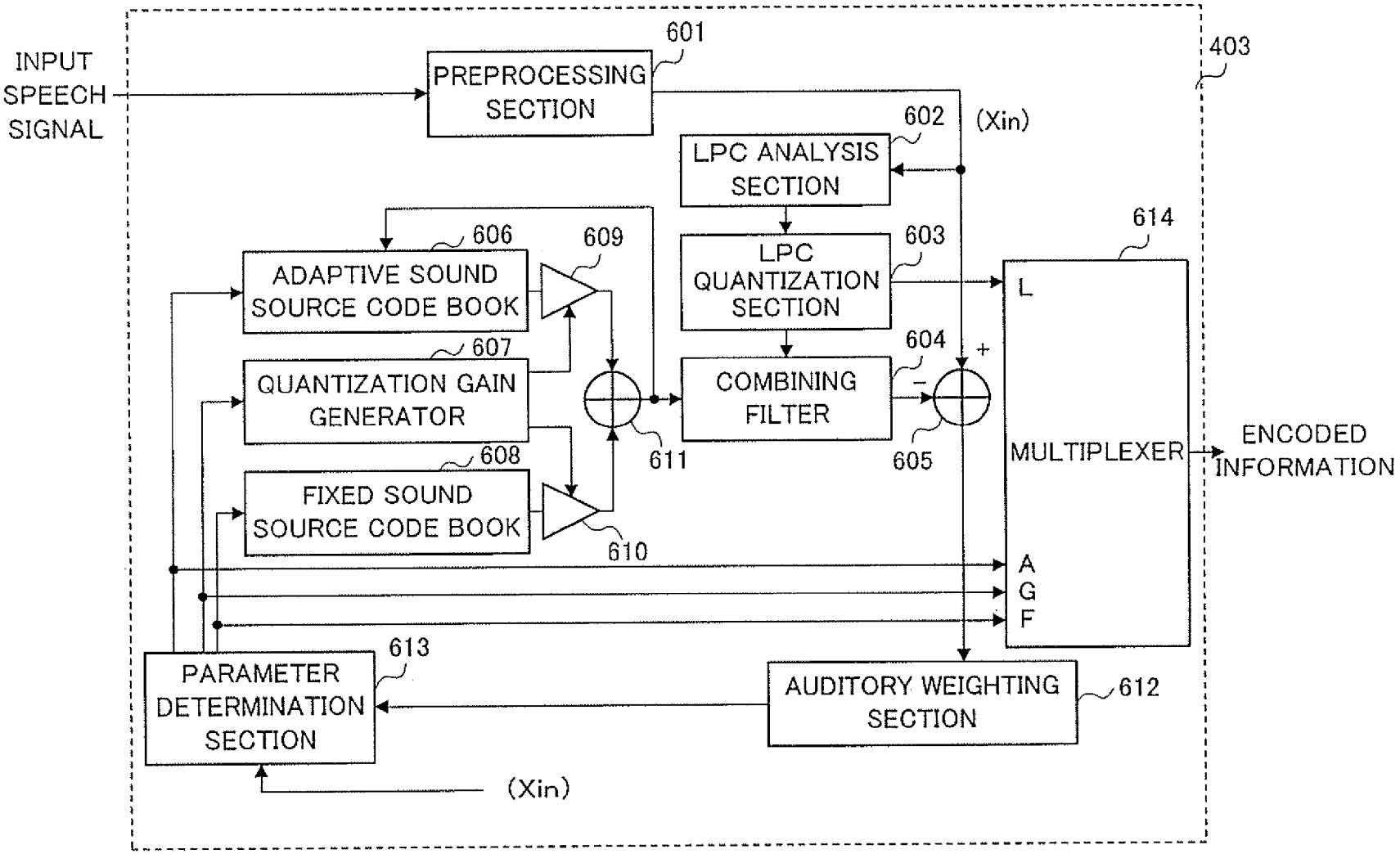
FIG. 7 is a block diagram showing the configuration of a speech encoding apparatus 403.

The special characteristic of speech signal transmitting apparatus 400 lies in the speech encoding apparatus 403. FIG. 7 is a block diagram showing the configuration of the speech encoding apparatus 403.

The speech encoding apparatus 403 in FIG. 7 is mainly composed of a preprocessing section 601, LPC analysis section 602, LPC quantization section 603, combining filter 604, adder 605, adaptive sound source code book 606, quantization gain generator 607, fixed sound source code book 608, multiplier 609, multiplier 610, adder 611, auditory weighting section 612, parameter determination section 613, and multiplexer 614.

In FIG. 7, an input speech signal output from the A/D converter 402 in FIG. 6 is input to the preprocessing section 601. The preprocessing section 601 performs high-pass filter processing that eliminates the DC component in the input speech signal, or waveform shaping processing and pre-emphasis processing concerned with improving the performance of later encoding processing, and outputs the processed speech signal (Xin) to the LPC analysis section 602, adder 605, and parameter determination section 613. CELP encoding that uses this preprocessing is disclosed in Unexamined Japanese Patent Publication No. 6-214600.

The LPC analysis section 602 performs linear predictive analysis using Xin, and outputs the result of the analysis (linear predictive coefficient) to the LPC quantization section 603.

The LPC quantization section 603 converts the LPC coefficient output from the LPC analysis section 602 to an LSF parameter. The LSF parameter obtained by this conversion is subjected to vector quantization as a quantization target vector, and an LPC code (L) obtained by vector quantization is output to the multiplexer 614. Also, the LPC quantization section 603 obtains an LSF area decoding spectral envelope parameter, converts the obtained decoding spectral envelope parameter to a decoding LPC coefficient, and outputs the decoding LPC coefficient obtained by the aforementioned conversion to the combining filter 604.

The combining filter 604 performs filter combination using the aforementioned encoding LPC coefficient and a drive sound source output from the adder 611, and outputs the composite signal to adder 605.

Adder 605 calculates an error signal for aforementioned Xin and the aforementioned composite signal, and outputs this error signal to the auditory weighting section 612. The auditory weighting section 612 performs auditory weighting on the error signal output from adder 605, calculates distortion between Xin and the composite signal in the auditory weighting area, and outputs this distortion to the parameter determination section 613.

The parameter determination section 613 determines the signals generated in the adaptive sound source code book 606, fixed sound source code book 608, and quantization gain generator 607 so that the encoding distortion output from the auditory weighting section 612 is minimized. Encoding performance can be further improved by determining the signals that should be output from the aforementioned three sections not only by minimizing the encoding distortion output from the auditory weighting section 612, but also by combined use with separate encoding distortion using Xin.

The adaptive sound source code book 606 buffers sound source signals output by adder 611 in the past, extracts an adaptive sound source vector from a location specified by a signal (A) output from the parameter determination section 613, and outputs this vector to multiplier 609.

The fixed sound source code book 608 outputs to multiplier 610 a vector of the form specified by a signal (F) output from the parameter determination section 613.

The quantization gain generator 607 outputs to multiplier 609 and multiplier 610, respectively, the adaptive sound source gain and fixed sound source gain specified by a signal (G) output from the parameter determination section 613.

Multiplier 609 multiplies the quantization adaptive sound source gain output from the quantization gain generator 607 by the adaptive sound source vector output from the adaptive sound source code book 606, and outputs the result of the multiplication to adder 611. Multiplier 610 multiplies the quantization fixed sound source gain output from the quantization gain generator 607 by the fixed sound source vector output from the fixed sound source code book 608, and outputs the result of the multiplication to adder 611.

Adder 611 has as inputs the adaptive sound source vector following gain multiplication from multiplier 609, and the fixed sound source vector from multiplier 610, and performs vector addition of the adaptive sound source vector and fixed sound source vector. Adder 611 then outputs the result of the vector addition to the combining filter 604 and adaptive sound source code book 606.

Finally, the multiplexer 614 has as inputs code L indicating the quantization LPC from the LPC quantization section 603, together with code A indicating the adaptive sound source vector, code F indicating the fixed sound source vector, and code G indicating the quantization gain, from the parameter determination section 613, quantizes these various items of information, and outputs them to the propagation path as encoded information.

Figure 8:
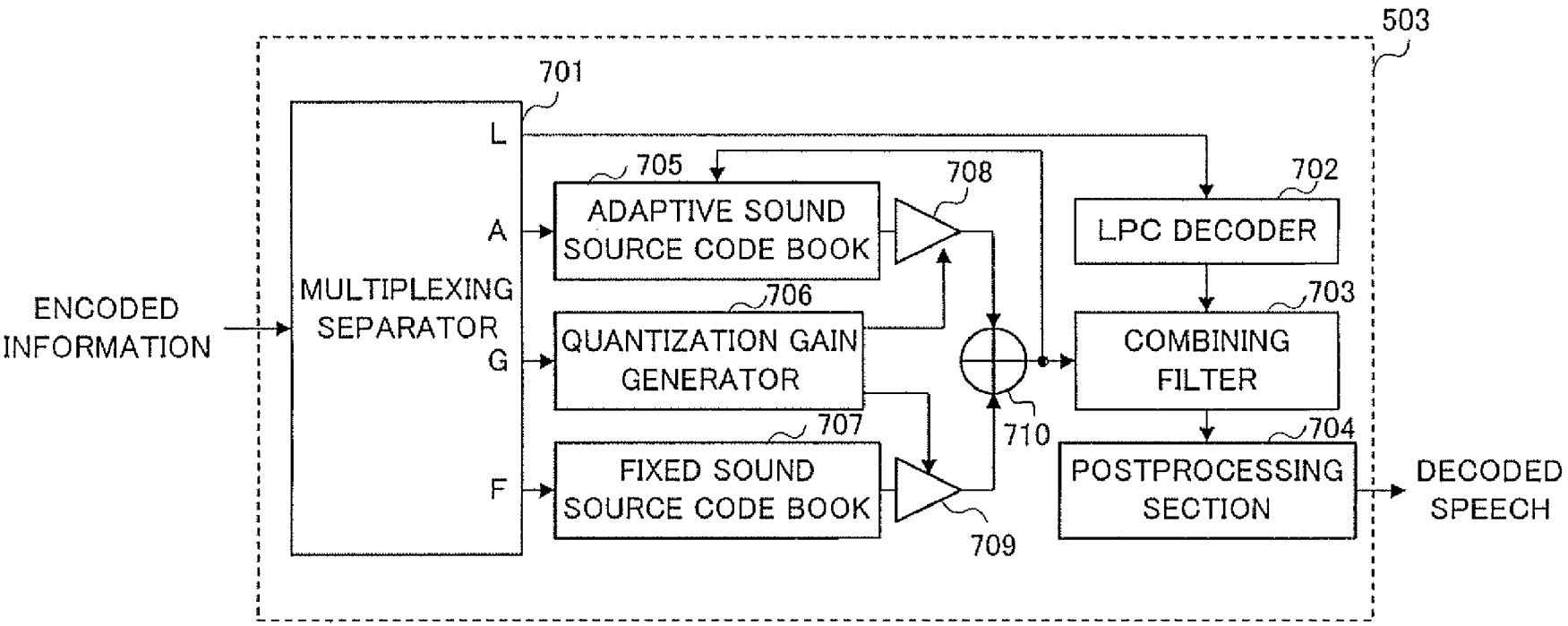
FIG. 8 is a block diagram showing the internal configuration of the speech decoding section 503 in FIG. 6.

Next, the speech decoding section 503 will be described in detail. FIG. 8 is a block diagram showing the internal configuration of the speech decoding section 503 in FIG. 6.

In FIG. 8, encoded information output from the RF demodulator 502 is input to a multiplexing separator 701, where multiplexed encoded information is separated into individual kinds of code information.

Separated LPC code L is output to an LPC decoder 702, separated adaptive sound source vector code A is output to an adaptive sound source code book 705, separated sound source gain code G is output to a quantization gain generator 706, and separated fixed sound source vector code F is output to a fixed sound source code book 707.

The LPC decoder 702 obtains a decoding spectral envelope parameter from code L output from the multiplexing separator 701 by means of the vector quantization decoding processing shown in Embodiment 1, and converts the obtained decoding spectral envelope parameter to a decoding LPC coefficient. The LPC decoder 702 then outputs the decoding LPC coefficient obtained by this conversion to a combining filter 703.

The adaptive sound source code book 705 extracts an adaptive sound source vector from the location specified by code A output from the multiplexing separator 701, and outputs it to a multiplier 708. The fixed sound source code book 707 generates the fixed sound source vector specified by code F output from the multiplexing separator 701, and outputs it to a multiplier 709.

The quantization gain generator 706 decodes the adaptive sound source vector gain and fixed sound source vector gain specified by sound source gain code G output from the multiplexing separator 701, and outputs these to multiplier 708 and multiplier 709, respectively.

Multiplier 708 multiplies the aforementioned adaptive code vector by the aforementioned adaptive code vector gain, and outputs the result to an adder 710. Multiplier 709 multiplies the aforementioned fixed code vector by the aforementioned fixed code vector gain, and outputs the result to the adder 710.

The adder 710 performs addition of the adaptive sound source vector and fixed sound source vector after gain multiplication output from multiplier 708 and multiplier 709, and outputs the result to the combining filter 703.

The combining filter 703 performs filter combination using the combining filter, with the encoding LPC coefficient supplied from the LPC decoder 702 as the filter coefficient, and with the sound source vector output from adder 710 as a drive signal, and outputs the combined signal to a postprocessing section 704.

The postprocessing section 704 executes processing to improve the subjective quality of speech, such as formant emphasis and pitch emphasis, processing to improve the subjective quality of stationary noise, and so forth, and then outputs a final decoded speech signal.

The present invention is not limited to the above-described embodiments, and various variations and modifications may be possible without departing from the scope of the present invention. For example, in the above embodiments a case has been described in which the present invention operates as a signal processing apparatus, but this is not a limitation, and it is also possible for this signal processing method to be implemented as software.

For example, a program that executes the above-described signal processing method may be stored beforehand in ROM (Read Only Memory), and operated by a CPU (Central Processing Unit).

It is also possible for a program that executes the above-described signal processing method to be stored on a computer-readable storage medium, for the program stored on the storage medium to be recorded in the RAM (Random Access Memory) of a computer, and for the computer to be operated in accordance with that program.

As is clear from the above descriptions, according to a pitch cycle search apparatus of the present invention, by not fixing the range of pitch cycles searched for at fractional accuracy, but searching a at fractional accuracy in the vicinity of a pitch cycle retrieved in the previous subframe, it is possible to improve search accuracy for speech signal linear predictive residuals, despite the shortness of pitch cycles, and to perform high-quality speech encoding and decoding.

This application is based on Japanese Patent Application No. 2001-234559 filed on Aug. 2, 2001, entire contents of which are expressly incorporated by reference herein.

INDUSTRIAL APPLICABILITY

The present invention is suitable for use in a mobile communication system in which speech signals are encoded and transmitted.

What is claimed:

1. A pitch cycle search range setting apparatus that sets a pitch cycle search object in pitch cycle search processing for searching for a pitch cycle included in a linear predictive residual on a per subframe basis, the pitch cycle search range setting apparatus comprising:

a pitch cycle indicator that sequentially outputs pitch cycle candidates within a predetermined pitch cycle search range at integral accuracy;

a previous subframe integral pitch cycle memory that stores an integral component of a pitch cycle selected in pitch cycle search processing of a previous subframe; and an adaptive sound source vector generator that sets, as the pitch cycle search object in pitch cycle search processing in a processing subframe section, a group of candidates comprising a group of integral-accuracy pitch cycle candidates output from the pitch cycle indicator and a group of fractional-accuracy pitch cycle search candidates that cover a pitch cycle near an integral component of the pitch cycle read from the previous subframe integral pitch cycle memory using fractional accuracy.

2. A pitch cycle search apparatus that searches for a pitch cycle included in a linear predictive residual on a per subframe basis, the pitch cycle search apparatus comprising:

a pitch cycle indicator that sequentially outputs pitch cycle candidates within a predetermined pitch cycle search range at integral accuracy;

a previous subframe integral pitch cycle memory that stores an integral component of a pitch cycle selected in pitch cycle search processing of a previous subframe;

an adaptive sound source vector generator that sets, as the pitch cycle search object in pitch cycle search processing in a processing subframe section, a group of candidates comprising a group of integral-accuracy pitch cycle candidates output from the pitch cycle indicator and a group of fractional-accuracy pitch cycle search candidates that cover the pitch cycle near the integral component of the pitch cycle read from the previous subframe integral pitch cycle memory using fractional accuracy, and that sequentially extracts and outputs adaptive sound source vectors corresponding to the pitch cycle candidates from an adaptive codebook;

a fractional pitch cycle adaptive sound source vector generator that interpolates the adaptive sound source vectors sequentially extracted from the adaptive codebook and output from the adaptive sound source vector generator, and that generates an adaptive sound source vector having a fractional-accuracy pitch cycle;

a comparator that performs relative size comparison of a value of an internal counter and a predetermined non-negative integer N so that the pitch cycle search processing in the processing subframe section is performed on the pitch cycle search object; and an optimal pitch cycle accuracy determiner that determines whether a pitch cycle selected as an optimal pitch cycle in pitch cycle search processing in the processing subframe section is of integral accuracy or of fractional accuracy, and that outputs a signal instructing the counter to operate in accordance with the determination;

wherein the comparator changes a value of the counter based on the signal instructing the counter to operate, outputs to the fractional pitch cycle adaptive sound source vector generator a signal for stopping the operation of the fractional pitch cycle adaptive sound source vector generator upon judging that the changed value of the counter is greater than the N, and outputs to the fractional pitch cycle adaptive sound source vector generator a signal for allowing the fractional pitch cycle adaptive sound source vector generator to operate upon judging that the changed value of the counter is smaller than or equal to the N.

3. The pitch cycle search apparatus according to claim 2, wherein the optimal pitch cycle accuracy determiner outputs a signal for resetting the value of the counter to 0 as a signal for instructing the counter to operate upon judging that accuracy of a pitch cycle selected in pitch cycle search processing in the processing subframe section is the integral accuracy, and outputs a signal for incrementing the counter as a signal for instructing the counter to operate upon judging that accuracy of the pitch cycle selected in pitch cycle search processing in the processing subframe section is the fractional accuracy.

4. The pitch cycle search apparatus according to claim 2, further comprising:

an integral-accuracy pitch cycle searcher that finds and outputs an integral-accuracy optimal pitch cycle index and a selection measure by searching for an integral-accuracy pitch cycle using the adaptive sound source vectors sequentially extracted from the adaptive codebook and outputted from the adaptive sound source vector generator;

a fractional-accuracy pitch cycle searcher that finds and outputs an fractional-accuracy optimal pitch cycle index and a selection measure by searching for a fractional-accuracy pitch cycle using the adaptive sound source vector having the fractional-accuracy pitch cycle generated in and output from the fractional pitch cycle adaptive sound source vector generator; and a distortion comparator that compares the selection measure for the integral-accuracy optimal pitch cycle with the selection measure for the fractional-accuracy optimal pitch cycle to determine a larger selection measure, that outputs an index of the larger selection measure as an index indicating an optimal pitch cycle in the processing subframe section, and that outputs an integral component of a pitch cycle having the larger selection measure, to the previous subframe integral pitch cycle storage section.

5. The pitch cycle search apparatus according to claim 4, wherein the N is previously set to infinity.

6. The pitch cycle search apparatus according to claim 4, wherein the N is previously set to be an upper limit of a consecutive number of times a fractional-accuracy pitch cycle is selected.

7. The pitch cycle search apparatus according to claim 4, wherein the N is previously set to increase or decrease in accordance with a degree of index transmission error occurrence frequency.

8. The pitch cycle search apparatus according to claim 2, further comprising a distortion comparator that finds and outputs an index indicating an optimal pitch cycle in the processing subframe section by a two-stage search of an open-loop search and closed-loop search using adaptive sound source vectors sequentially extracted from the adaptive codebook and output from the adaptive sound source vector generator, and an adaptive sound source vector having a fractional-accuracy pitch cycle generated in and output from the fractional pitch cycle adaptive sound source vector generator, and that outputs an integral component of the optimal pitch cycle to the previous subframe integral pitch cycle storage section.

9. A speech encoding apparatus comprising: the pitch cycle search apparatus according to claim 2 that generates the adaptive sound source vectors using the adaptive codebook;

a fixed sound source vector generator that generates a fixed sound source vector using a fixed codebook;

a parameter quantizer that quantizes and encodes a parameter indicating a spectral characteristic of an input speech signal;

a filter that synthesizes a composite speech signal using a sound source vector generated using the fixed sound source vector, the adaptive sound source vector, and the parameter; and a determiner that determines an output from the fixed sound source vector generator and an output from the pitch cycle search apparatus to reduce a distortion between the input speech signal and the composite speech signal.

10. A speech decoding apparatus comprising:

a decoder that decodes an index indicating an adaptive sound source vector pitch cycle encoded by a speech encoding apparatus using the decoding adaptive sound source vector generator according to claim 2, a fixed sound source vector generator that generates a fixed sound source vector from a fixed codebook;

a decoder that decodes a parameter indicating a spectral characteristic encoded by said speech encoding apparatus; and a decoder that decodes a sound source vector determined in said speech encoding apparatus from said fixed sound source vector generator and said decoding adaptive sound source vector generating apparatus, and synthesizes a composite speech signal from a decoded sound source vector and said parameter.

11. A speech signal receiving apparatus comprising:

a receiving antenna that receives a reception radio wave;

an RF demodulation apparatus that performs demodulation processing on a signal received by said receiving antenna;

the speech decoding apparatus according to claim 10 that performs decoding processing on information obtained by said RF demodulation apparatus;

a D/A conversion apparatus that performs D/A conversion of a digital speech signal decoded by said speech decoding apparatus; and a speech output apparatus that converts an electrical signal output from said D/A conversion apparatus to a speech signal.

12. A mobile station apparatus that has a speech signal transmitting apparatus and performs radio communications with a base station apparatus, said speech signal transmitting apparatus comprising:

a speech input apparatus that converts a speech signal to an electrical signal;

an A/D conversion apparatus that converts a signal output by said speech input apparatus to a digital signal;

the speech encoding apparatus according to claim that performs encoding of a digital signal output from said A/D conversion apparatus;

an RF modulation apparatus that performs modulation processing on encoded information output from said speech encoding apparatus; and a transmitting antenna that converts a signal output from said RF modulation apparatus to a radio wave and transmits the radio wave.

13. A mobile station apparatus that has a speech signal receiving apparatus and performs radio communications with a base station apparatus, said speech signal receiving apparatus comprising:

a receiving antenna that receives a reception radio wave;

an RF demodulation apparatus that performs demodulation processing on a signal received by said receiving antenna;

the speech decoding apparatus according to claim 10 that performs decoding processing on information obtained by said RE demodulation apparatus;

a D/A conversion apparatus that performs D/A conversion of a digital speech signal decoded by said speech decoding apparatus; and a speech output apparatus that converts an electrical signal output from said D/A conversion apparatus to a speech signal.

14. A base station apparatus that has a speech signal receiving apparatus and performs radio communications with a mobile station apparatus, said speech signal receiving apparatus comprising:

a receiving antenna that receives a reception radio wave;

an RF demodulation apparatus that performs demodulation processing on a signal received by said receiving antenna;

the speech decoding apparatus according to claim 10 that performs decoding processing on information obtained by said RF demodulation apparatus;

a D/A conversion apparatus that performs D/A conversion of a digital speech signal decoded by said speech decoding apparatus; and a speech output apparatus that converts an electrical signal output from said D/A conversion apparatus to a speech signal.

15. A decoding adaptive sound source vector generating apparatus comprising:

a last subframe integral pitch cycle storage that stores a pitch cycle selected in a previous subframe section;

a pitch cycle judger that finds an optimal adaptive sound source vector pitch cycle using a pitch cycle selected in a previous subframe received from said last subframe integral pitch cycle storage and an index received as input;

an adaptive sound source vector generator that extracts, from an adaptive codebook an adaptive sound source vector that has a pitch cycle received from said pitch cycle judger, outputs the extracted adaptive sound source vector if a pitch cycle is of integral accuracy, or outputs the extracted adaptive sound source vector if a pitch cycle is of fractional accuracy; and a fractional pitch cycle adaptive sound source vector generator that generates and outputs an adaptive sound source vector that has a fractional-accuracy pitch cycle from an adaptive sound source vector received from said adaptive sound source vector generator.

* * * * *

UNITED STATES PATENT AND TRADEMARK OFFICE

CERTIFICATE OF CORRECTION

PATENT NO. : 7,542,898 B2
APPLICATION NO. : 11/619667
DATED : June 2, 2009
INVENTOR(S) : Sato et al.

It is certified that error appears in the above-identified patent and that said Letters Patent is hereby corrected as shown below:

On the Cover Page, Abstract Item (57), line 4, "output spitch" should be --outputs pitch--.

At column 18, line 36 (claim 12 line 9), "claim" should be --claim 10--.

At column 18, line 56 (claim 13 line 11), "RE" should be --RF--.

Signed and Sealed this

Thirteenth Day of October, 2009

David J. Kappos

David J. Kappos
*Director of the United States Patent and Trademark Office*